US008545537B2

(12) United States Patent
Murphy Matro

(10) Patent No.: US 8,545,537 B2
(45) Date of Patent: Oct. 1, 2013

(54) DEVELOPMENTAL PACIFIER

(76) Inventor: Erin Murphy Matro, Latrobe, PA (US)

( * ) Notice: Subject to any disclaimer, the term of this patent is extended or adjusted under 35 U.S.C. 154(b) by 196 days.

(21) Appl. No.: 12/940,029

(22) Filed: Nov. 4, 2010

(65) Prior Publication Data

US 2011/0054527 A1 Mar. 3, 2011

Related U.S. Application Data

(63) Continuation-in-part of application No. 11/766,458, filed on Jun. 21, 2007, now abandoned.

(51) Int. Cl.
*A61J 17/00* (2006.01)

(52) U.S. Cl.
USPC ..... 606/234

(58) Field of Classification Search
USPC ..... 606/234–236; D24/194
See application file for complete search history.

(56) References Cited

U.S. PATENT DOCUMENTS

| | | | | | |
|---|---|---|---|---|---|
| 2,388,915 | A | * | 11/1945 | Heilborn | 215/11.1 |
| 3,610,248 | A | * | 10/1971 | Davidson | 606/236 |
| 4,796,628 | A | * | 1/1989 | Anderson | 606/236 |
| D336,520 | S | | 6/1993 | McDaniel | |
| 5,263,975 | A | * | 11/1993 | La Rocca | 606/234 |
| 5,275,619 | A | * | 1/1994 | Engebretson et al. | 606/236 |
| 5,711,759 | A | * | 1/1998 | Smith et al. | 601/139 |
| 5,868,131 | A | * | 2/1999 | Murchie | 128/204.13 |
| 6,041,950 | A | | 3/2000 | Soehnlein | |
| 6,161,710 | A | | 12/2000 | Dieringer et al. | |
| 6,228,105 | B1 | | 5/2001 | Johansen et al. | |
| D446,626 | S | * | 8/2001 | Huang | D1/102 |
| D457,640 | S | | 5/2002 | Alexandre | |
| D462,773 | S | * | 9/2002 | Viana et al. | D24/195 |
| 6,699,264 | B1 | | 3/2004 | Rohrig | |
| D490,158 | S | | 5/2004 | Ajibolade | |
| 6,736,830 | B2 | * | 5/2004 | Roust | 606/234 |
| 6,752,824 | B2 | * | 6/2004 | Yancy | 606/234 |
| 6,968,964 | B2 | | 11/2005 | Gilmore | |
| 7,134,564 | B2 | | 11/2006 | Verbovszky | |
| D593,203 | S | * | 5/2009 | Kliegman et al. | D24/194 |
| 7,934,612 | B1 | * | 5/2011 | Mullen | 215/11.1 |
| 2002/0030029 | A1 | | 3/2002 | Hakim | |
| 2003/0032984 | A1 | | 2/2003 | Hakim | |
| 2003/0100922 | A1 | * | 5/2003 | Fitzpatrick et al. | 606/234 |
| 2003/0176891 | A1 | | 9/2003 | Frederic | |
| 2004/0220618 | A1 | | 11/2004 | Rohrig | |
| 2005/0288712 | A9 | | 12/2005 | Hakim | |
| 2006/0036285 | A1 | | 2/2006 | Davis | |
| 2007/0208380 | A1 | * | 9/2007 | Ebner | 606/235 |

FOREIGN PATENT DOCUMENTS

| | | |
|---|---|---|
| WO | WO 00/10505 A1 | 3/2000 |
| WO | WO 01/00136 A1 | 1/2001 |

* cited by examiner

*Primary Examiner* — Katherine Dowe
(74) *Attorney, Agent, or Firm* — Robert D. Gunderman, Jr.; Patent Technologies, LLC

(57) ABSTRACT

A Developmental Pacifier is provided to help infants with functional feeding development and to assist with specific developmental problems in young children such as developmental delays, prematurity, gastro-esophageal reflux, autism spectrum disorder, hypotonicity, cerebral palsy, Down's syndrome, microcephaly, and other sensory integrative dysfunctions. The developmental pacifier of the present invention encourages acceptance of food textures and stimulates oral-motor awareness, and reduces or eliminates functional feeding problems in children. The Developmental Pacifier has a nipple with an upper portion and a base portion, a base, and sensory elements. A series of Developmental Pacifiers with varying sensory elements may be used for certain treatment regimens as prescribed by a medical practitioner, pediatric occupational therapist, or other pediatric specialist.

15 Claims, 7 Drawing Sheets

DEVELOPMENTAL PACIFIER

CROSS-REFERENCE TO RELATED APPLICATIONS

This application is a continuation in part of application Ser. No. 11/766,458 filed on Jun. 21, 2007.

BACKGROUND OF THE INVENTION

1. Field of the Invention

This invention relates generally to pacifiers for infants, and more particularly to a pacifier for treating various developmental delays and disorders in children.

2. Description of Related Art

Infant pacifiers are known and available. Common among infant pacifiers are elements including a nipple on which an infant can suck, a base or shield upon which the nipple is attached to prevent the infant from choking or otherwise ingesting the nipple, and often times a handle or similar structure to allow the infant or an adult to grip and place the pacifier.

There has been a trend in recent years to improve upon the basic infant pacifier design by making the nipple structure flatter and angled, so-called "orthodontic style" pacifiers. The purpose of such orthodontic style designs being to reduce the incidence of dental deformation and also to improve the sucking process.

Pacifiers are commonly made from a moderately soft material such as an elastomer, the surface of the nipple of said pacifier commonly being smooth. Teethers, on the other hand, are often made from a harder durometer material and are not commonly in the shape of a nipple. Teethers may also contain hard bumps to encourage chewing and associated break through of new teeth. In addition, pacifiers and teethers are intended to sooth and calm stressed or otherwise agitated infants. The pacifiers of the prior art were not intended to, nor do they, address infants with specific developmental problems such as developmental delays, pre-maturity, gastro-esophageal reflux, autism spectrum disorders, sensory modulation disorders, hypotonicity, cerebral palsy, Down's Syndrome, microcephaly, and other sensory integrative dysfunctions. The applicant, through extensive work as a pediatric occupational therapist, has invented a novel, unique and non-obvious developmental pacifier to help infants with functional feeding development and to assist infants with sensory integrative dysfunctions.

It is an object of the present invention to provide a developmental pacifier that assists infants with specific developmental problems such as developmental delays, pre-maturity, gastro-esophageal reflux, autism spectrum disorder, hypotonicity, cerebral palsy, Down's Syndrome and microcephaly. It is another object of the present invention to provide a developmental pacifier that encourages acceptance of food textures and stimulates oral-motor awareness. It is another object of the present invention to provide a developmental pacifier that reduces or eliminates functional feeding problems in children. It is yet another object of the present invention to provide a series of developmental pacifiers that progressively and systematically introduces texture to assist infants with specific developmental problems such as developmental delays, pre-maturity, gastro-esophageal reflux, autism spectrum disorder, hypotonicity, cerebral palsy, Down's Syndrome and microcephaly. It is yet another object of the present invention to provide a series of developmental pacifiers that encourages acceptance of food textures and stimulates oral-motor awareness. It is still another object of the present invention to provide a series of developmental pacifiers that reduces or eliminates functional feeding problems in children. The present invention, and the embodiments described herein, provide for a Developmental Pacifier and a series of cooperatively inter-related Developmental Pacifiers for addressing various developmental difficulties in children.

BRIEF SUMMARY OF THE INVENTION

In accordance with the present invention, there is provided a developmental pacifier comprising a nipple having an upper portion and a lower portion, the length of the upper portion being approximately the length of the lower portion, and the upper portion being 20% to 80% of the diameter of the lower portion, a plurality of sensory elements attached to the surface of said nipple, a base attached to the lower portion of said nipple, the base being substantially oval in shape, and a grip attached to the base.

The foregoing paragraph has been provided by way of introduction, and is not intended to limit the scope of the following claims.

BRIEF DESCRIPTION OF THE DRAWINGS

The invention will be described by reference to the following drawings, in which like numerals refer to like elements, and in which.

Figure 1:
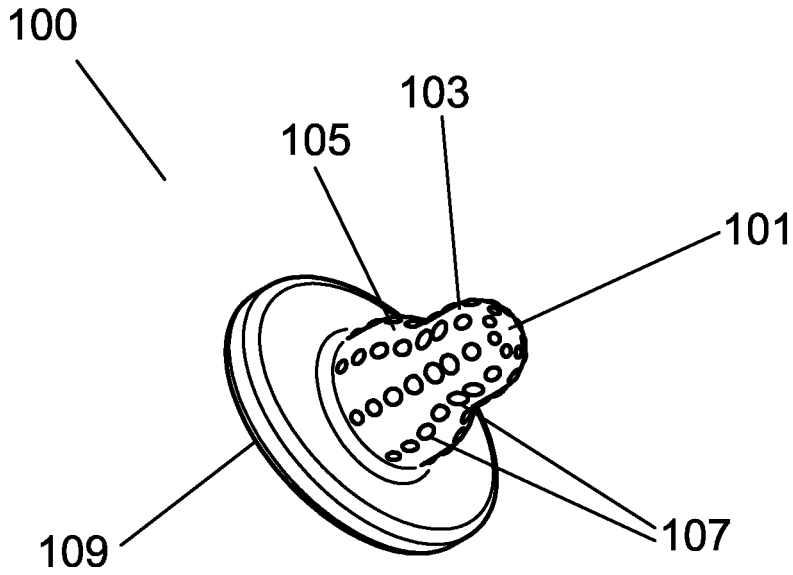
FIG. 1 is a perspective view of the Developmental Pacifier according to one embodiment of the present invention.

The present invention will be described in connection with a preferred embodiment, however, it will be understood that there is no intent to limit the invention to the embodiment described. On the contrary, the intent is to cover all alternatives, modifications, and equivalents as may be included within the spirit and scope of the invention as defined by this specification and the appended claims.

DESCRIPTION OF THE PREFERRED EMBODIMENTS

For a general understanding of the present invention, reference is made to the drawings. In the drawings, like reference numerals have been used throughout to designate identical elements.

FIGS. 1-13 illustrate a pacifier which generally comprises a nipple, a base, and sensory elements. The sensory elements may vary in dimensions and geometric arrangement. The sensory elements may also, in some embodiments of the present invention, be attached to the base in addition to being attached to the nipple. It is important to note that various combinations of the various embodiments of the present invention may be used for certain treatment regimens as prescribed by a medical practitioner, pediatric occupational therapist, or other pediatric specialist. Such a system for treating functional difficulties in children may include, for example, a series of developmental pacifiers each with progressively larger bumps, ridges, or other sensory elements.

FIG. 1 is a perspective view of the Developmental Pacifier 100 according to one embodiment of the present invention. Referring to FIG. 1, a nipple 101 is shown. The shape of the nipple 101 is similar to that of a maternal nipple, the nipple 101 having a nipple upper portion 103 that is of a lesser diameter than the nipple base portion 105. The length of the nipple upper portion 103 is approximately equal to the length of the nipple base portion 105. Attached to the surface of the nipple 101 are sensory elements 107 that may, in some embodiments of the present invention, be bumps. The size of the bumps may vary. The sensory elements may also, in other embodiments of the present invention, be other textured geometric shapes such as triangles, squares, stars, hearts, circles, rectangles, and the like. The sensory elements 107 may also, in some embodiments of the present invention, be arranged in a pattern, for example, in rows that are parallel to the length of the nipple 101. The sensory elements 107 may also vary in size. Attached to the nipple is a base 109. The base 109 provides a structural element for the child to grasp, and also serves to prevent choking or subsequent ingestion of the nipple 101. The base 109 has a rounded geometry such as that of an oval. The developmental pacifier 100 that comprises a nipple, a base and sensory elements are preferably formed integrally with one another and made of the same material. They also may, in some embodiments of the present invention, be formed separately from the same or different materials and joined to one another by heat bonding, sonic welding, or the like. The developmental pacifier 100 is made from a moderately soft material such as an elastomer, such as a medical grade thermoplastic elastomer, for example, KRATON® brand thermoplastic elastomer (KRATON® is a registered trademark of Kraton Polymers, LLC, Houston, Tex.). Other materials or combinations of materials that are suitable for infant pacifiers may also be used. Another example is Class Six Tested Food Grade Silicone.

Figure 2:
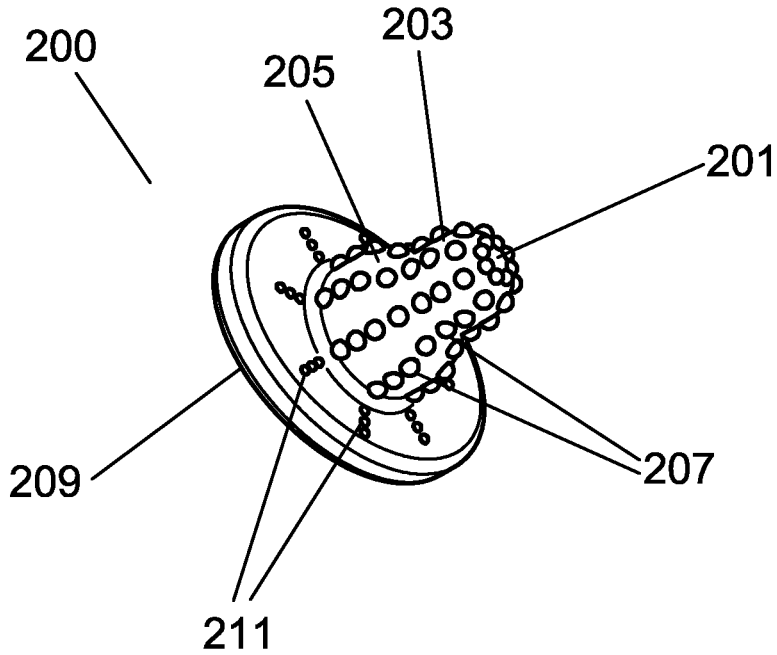
FIG. 2 is a perspective view of the Developmental Pacifier according to a second embodiment of the present invention.

Referring now to FIG. 2, a perspective view of a second embodiment of the Developmental Pacifier 200 is shown. Referring to FIG. 2, a nipple 201 is shown. The shape of the nipple 201 is similar to that of a maternal nipple, the nipple 201 having a nipple upper portion 203 that is of a lesser diameter than the nipple base portion 205. The length of the nipple upper portion 203 is approximately equal to the length of the nipple base portion 205. Attached to the surface of the nipple 201 are sensory elements 207 that may, in some embodiments of the present invention, be bumps. The size of the bumps may vary. The sensory elements may also, in other embodiments of the present invention, be other textured geometric shapes such as triangles, squares, stars, hearts, circles, rectangles, and the like. The sensory elements 207 may also, in some embodiments of the present invention, be arranged in a pattern, for example, in rows that are parallel to the length of the nipple 201. The sensory elements 107 may also vary in size. Attached to the nipple is a base 109. The base 209 provides a structural element for the child to grasp, and also serves to prevent choking or subsequent ingestion of the nipple 201. The base 209 has a rounded geometry such as that of an oval. Further, FIG. 2 shows sensory elements 211 attached to the nipple side of the base 209 to provide for additional sensory stimulation around the base of the lips while in use by a child. The developmental pacifier 200 that comprises a nipple, a base and sensory elements are preferably formed integrally with one another and made of the same material. They also may, in some embodiments of the present invention, be formed separately from the same or different materials and joined to one another by heat bonding, sonic welding, or the like. The developmental pacifier 200 is made from a moderately soft material such as an elastomer, such as a medical grade thermoplastic elastomer, for example, KRATON® brand thermoplastic elastomer (KRATON® is a registered trademark of Kraton Polymers. LLC, Houston, Tex.). Other materials or combinations of materials that are suitable for infant pacifiers may also be used. Another example is Class Six Tested Food Grade Silicone.

Figure 3:
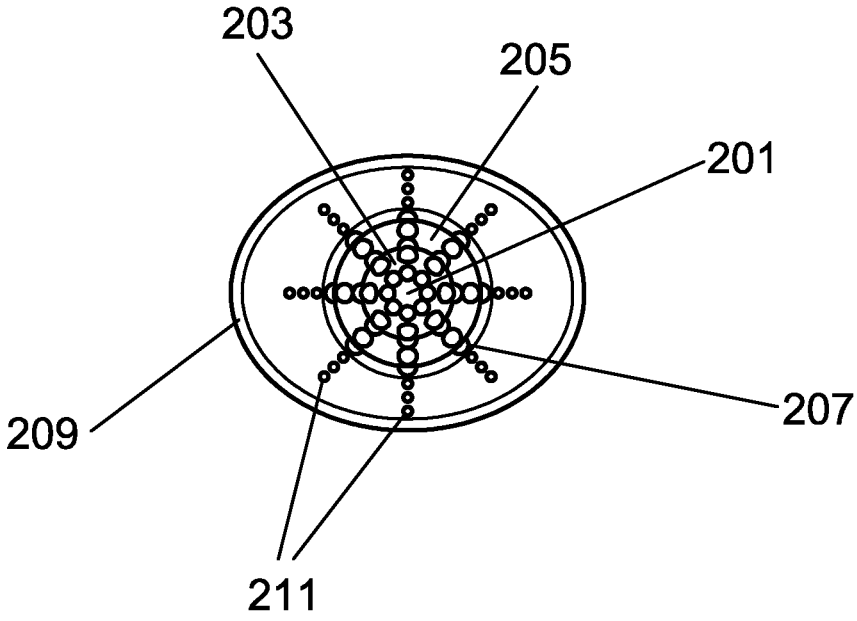
FIG. 3 is a plan view of the Developmental Pacifier according to a second embodiment of the present invention.

FIG. 3 shows a plan view of the developmental pacifier from the nipple side of the base. The sensory elements 211 are shown in rows and continuing on to the base 209. Other embodiments of the present invention may contain varying geometric patterns of sensory elements, or random placement of the sensory elements 211.

Figure 4:
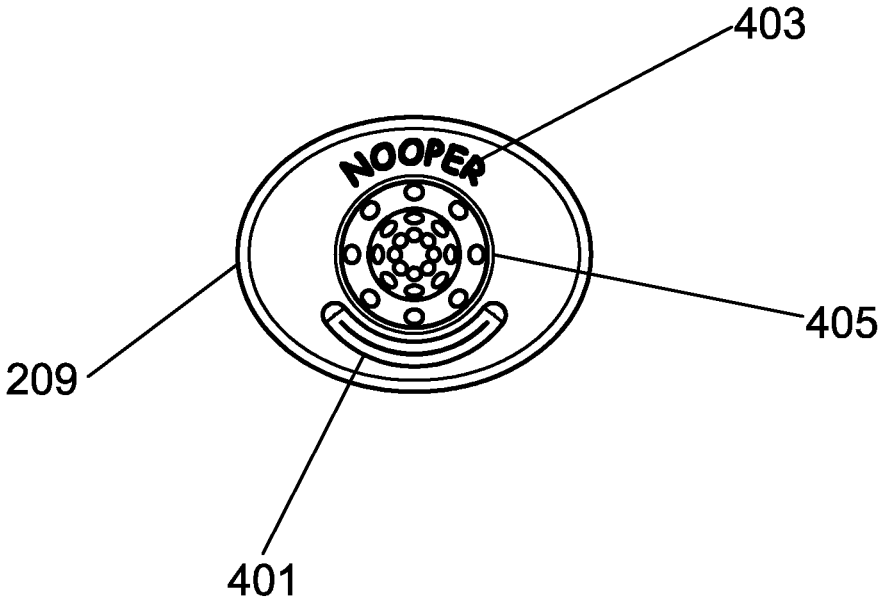
FIG. 4 is a plan view of the opposing side of the Developmental Pacifier according one embodiment of the present invention.
Figure 5:
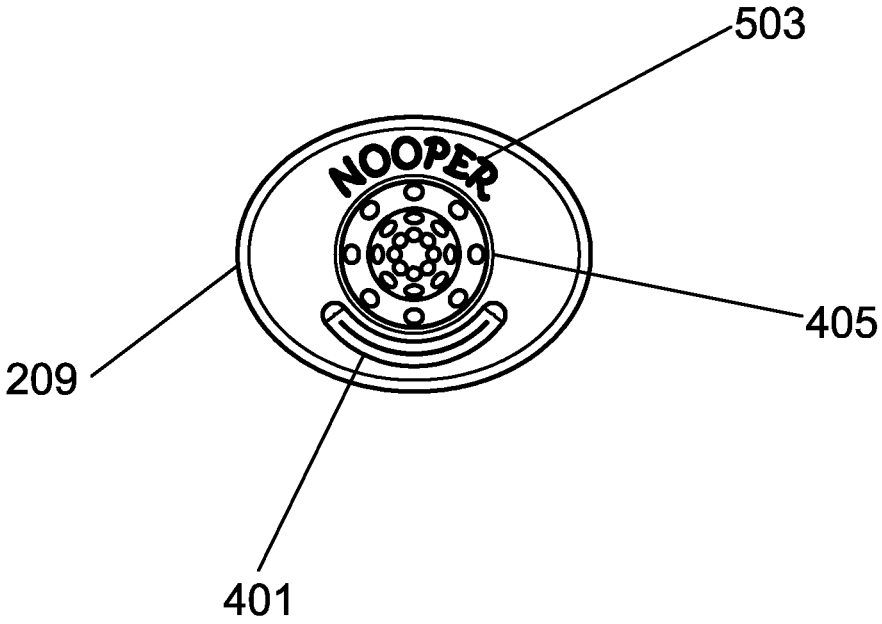
FIG. 5 is a plan view of the opposing side of the Developmental Pacifier according to one embodiment of the present invention with an alternative mark.

Turning now to FIG. 4, a plan view of the opposing side of the developmental pacifier is shown. The interior of the nipple 405 is shown. The interior may be hollow, solid, or filled with another material such as a liquid, gel, solid, or gas. Further depicted in FIG. 4 is a grip 401 that is semi-circular in shape that may be used by the child or an adult to grasp, position, place or remove the developmental pacifier. Also shown in FIG. 4 is a mark 403 such as the word "Nooper" that may, in some embodiments of the present invention, be molded or otherwise printed on the base 209 of the developmental pacifier. FIG. 5 is a plan view of the opposing side of the developmental pacifier with an alternative embodiment of the identifying mark 503.

Figure 6:
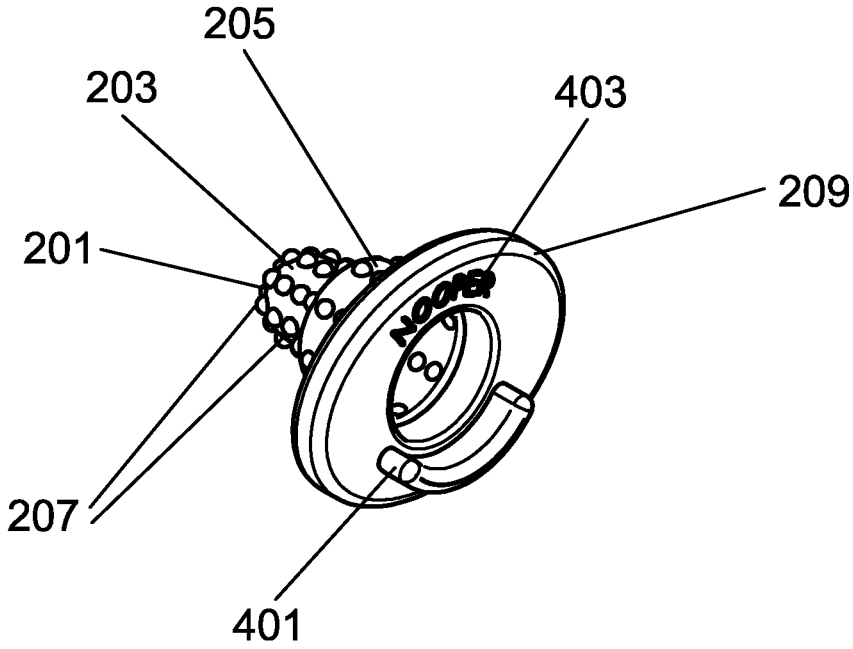
FIG. 6 is a perspective view of the opposing side of the developmental pacifier according to a second embodiment of the present invention.

To clearly show all views of the developmental pacifier, FIG. 6 is a perspective view of the opposing side of the developmental pacifier, all elements shown in FIG. 6 being previously described herein.

Figure 7:
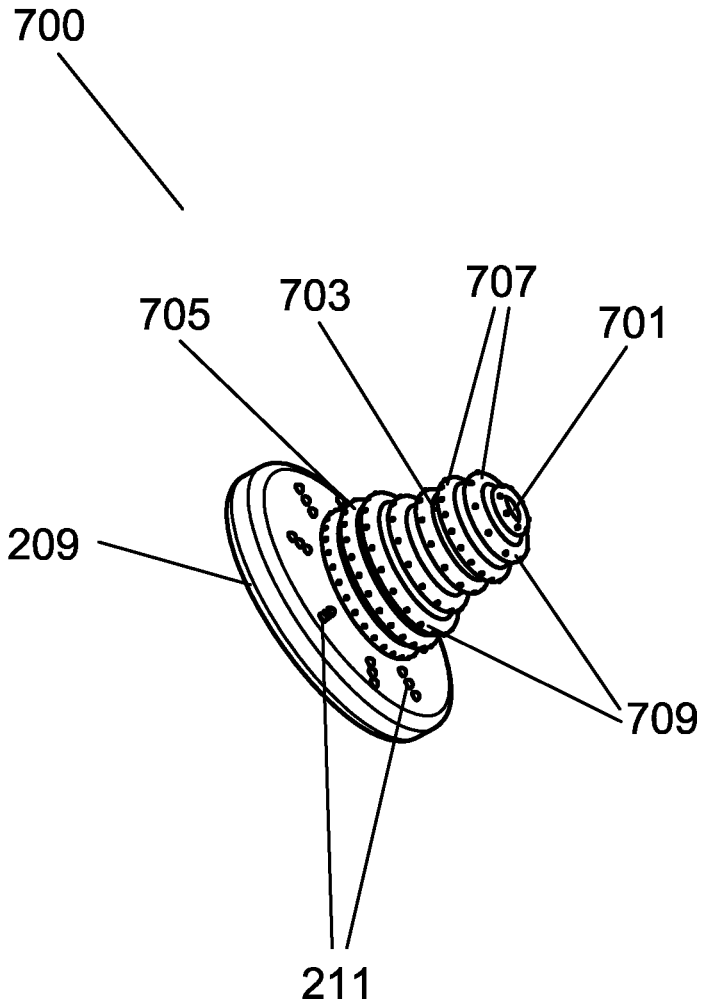
FIG. 7 is a perspective view of the Developmental Pacifier according to a third embodiment of the present invention.

A third embodiment 700 of the developmental pacifier is depicted in FIG. 7. Referring to FIG. 7, a nipple 701 is shown. The shape of the nipple 701 is similar to that of a maternal nipple, the nipple 701 having a nipple upper portion 703 that is of a lesser diameter than the nipple base portion 705. The length of the nipple upper portion 703 is approximately equal to the length of the nipple base portion 705. Attached to the surface of the nipple 701 are sensory ridges 707 that may, in some embodiments of the present invention, further contain sensory elements 709 along the surface of the ridges. The sensory elements 709 may, in some embodiments of the present invention, be bumps. The size of the bumps may vary. The sensory elements may also, in other embodiments of the present invention, be other textured geometric shapes such as triangles, squares, stars, hearts, and the like. The sensory elements 709 may also vary in size. Attached to the nipple is a base 209. The base 209 provides a structural element for the child to grasp, and also serves to prevent choking or subsequent ingestion of the nipple 701. The base 209 has a rounded geometry such as that of an oval. Further, FIG. 7 shows sensory elements 211 attached to the nipple side of the base 209 to provide for additional sensory stimulation around the base of the lips while in use by a child. The developmental pacifier 700 that comprises a nipple, a base and sensory elements are preferably formed integrally with one another and made of the same material. They also may, in some embodiments of the present invention, be formed separately from the same or different materials and joined to one another by heat bonding, sonic welding, or the like. The developmental pacifier 700 is made from a moderately soft material such as an elastomer, such as a medical grade thermoplastic elastomer, for example, KRATON® brand thermoplastic elastomer (KRATON® is a registered trademark of Kraton Polymers, LLC, Houston, Tex.). Other materials or combinations of materials that are suitable for infant pacifiers may also be used. Another example is Class Six Tested Food Grade Silicone.

Figure 8:
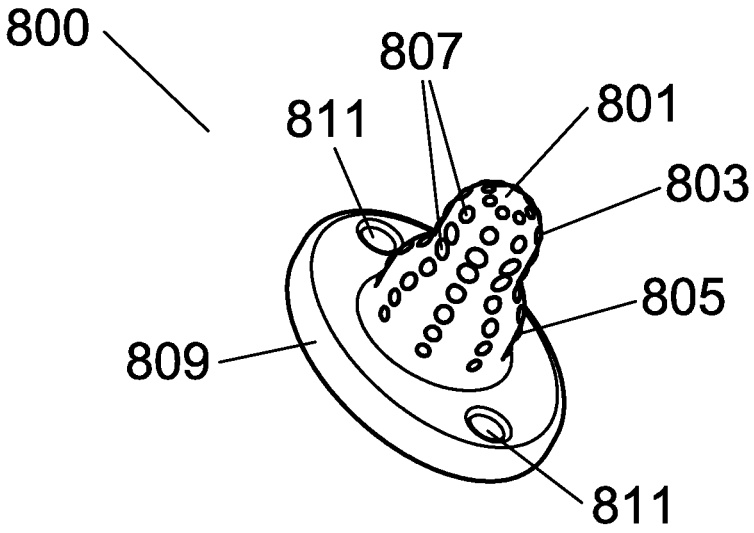
FIG. 8 is a perspective view of the Developmental Pacifier according to another embodiment of the present invention.

Another embodiment of the present invention is depicted by way of FIGS. 8-13. FIG. 8 is a perspective view of the Developmental Pacifier according to another embodiment of the present invention. Referring to FIG. 8, a nipple 801 is shown. The shape of the nipple 801 is similar to that of a maternal nipple, the nipple 801 having a nipple upper portion 803 that is of a lesser diameter than the nipple base portion 805. The length of the nipple upper portion 803 is approximately equal to the length of the nipple base portion 805. Attached to the surface of the nipple 801 are sensory elements 807 that may, in some embodiments of the present invention, be bumps. The size of the bumps may vary. The sensory elements may also, in other embodiments of the present invention, be other textured geometric shapes such as triangles, squares, stars, hearts, circles, rectangles, and the like. The sensory elements 807 may also, in some embodiments of the present invention, be arranged in a pattern, for example, in rows longitudinal to the length of the nipple 801 and sharing a common origin at the tip of the nipple 801. The sensory elements 807 may also vary in size. Attached to the nipple is a base 809. The base 809 provides a structural element for the child to grasp, and also serves to prevent choking or subsequent ingestion of the nipple 801. The base 809 has a rounded geometry such as that of an oval. The Developmental Pacifier that comprises a nipple, a base and sensory elements are preferably formed integrally with one another and made of the same material. They also may, in some embodiments of the present invention, be formed separately from the same or different materials and joined to one another by heat bonding, sonic welding, or the like. The Developmental Pacifier is made from a moderately soft material such as an elastomer, such as a medical grade thermoplastic elastomer, for example, KRATON® brand thermoplastic elastomer (KRATON® is a registered trademark of Kraton Polymers, LLC, Houston, Tex.). Other materials or combinations of materials that are suitable for infant pacifiers may also be used. Another example is Class Six Tested Food Grade Silicone. Also depicted in FIG. 8 are safety holes 811 that are placed for safety considerations. In an exemplary embodiment of the present invention, each safety hole perforates the base 809 symmetrically and in proximity to a grip (not shown in FIG. 8). Safety holes may also be placed in other locations or be omitted entirely.

Figure 9:
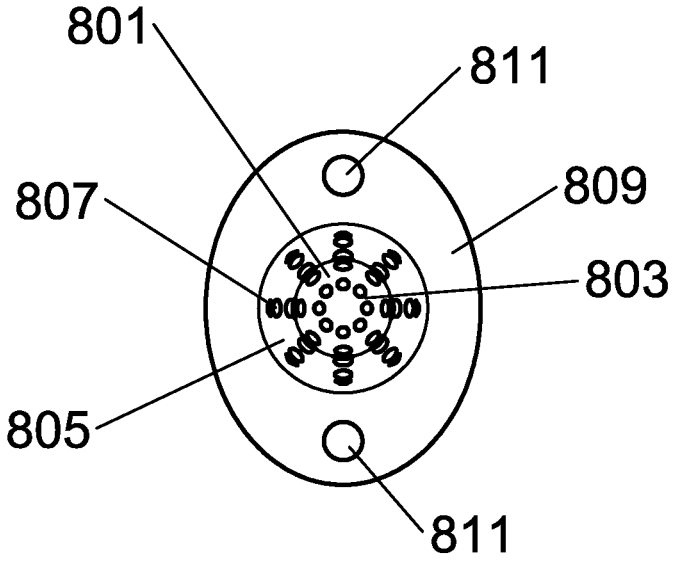
FIG. 9 is a plan view of the Developmental Pacifier according to another embodiment of the present invention.

FIG. 9 depicts a plan view of the Developmental Pacifier of FIG. 8 looking down at the nipple side of the Developmental Pacifier. The nipple 801, nipple upper portion 803 and nipple base portion 805 can be clearly seen along with the sensory elements 807, base 809, and safety holes 811.

Figure 10:
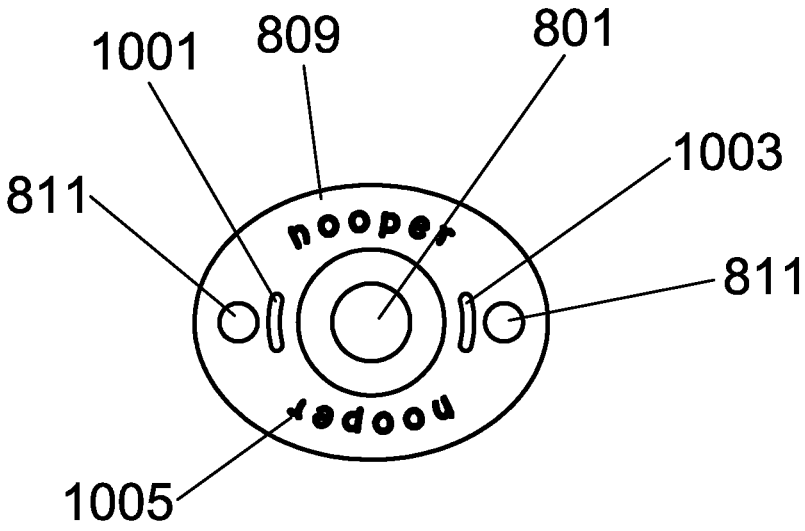
FIG. 10 is a plan view of the opposing side of the Developmental Pacifier according to another embodiment of the present invention.

FIG. 10 is a plan view of the opposing side of the Developmental Pacifier of FIG. 8. Depicted is a first grip 1001 and a second grip 1003. In one embodiment of the present invention, each grip is a curved rectangular piece protruding from the back side of said developmental pacifier and placed symmetrically on each side of the base 809. Although other grip geometries and locations are within the scope of the present invention, applicants have found that the geometries and symmetrical placement of the two grips along with the proportional sizing of the grips with respect to the base provides for a structure that is comforting and easy to use to an infant.

Figure 11:
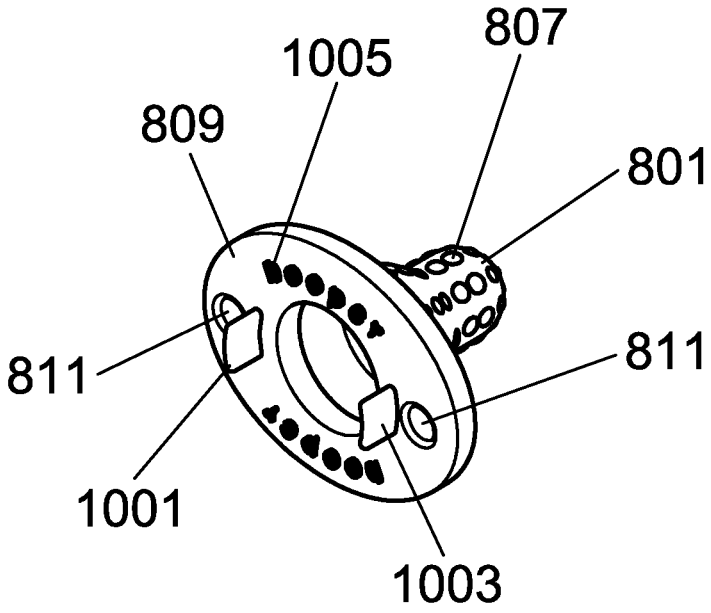
FIG. 11 is a perspective view of the opposing side of the developmental pacifier according to another embodiment of the present invention.

FIG. 11 is a perspective view of the opposing side of the Developmental Pacifier depicted in FIG. 8. In some embodiments of the present invention, an identifying mark 1005 may be molded into or otherwise placed on the base 809.

Figure 12:
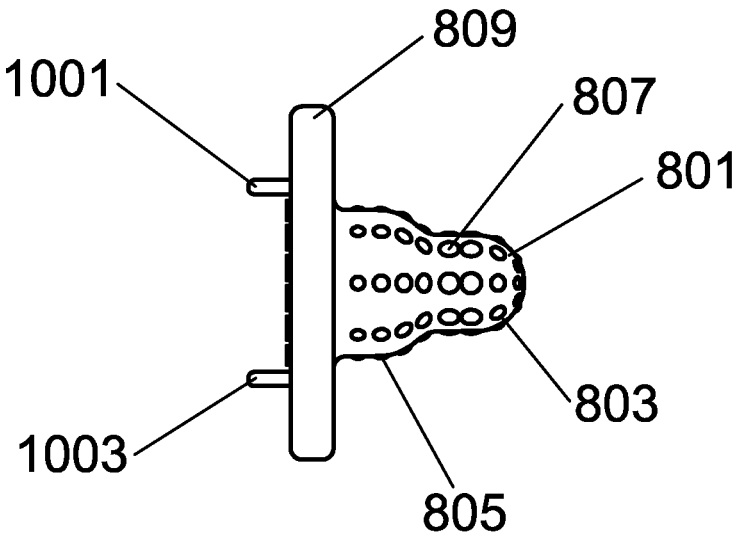
FIG. 12 is a side view of the developmental pacifier according to another embodiment of the present invention.
Figure 13:
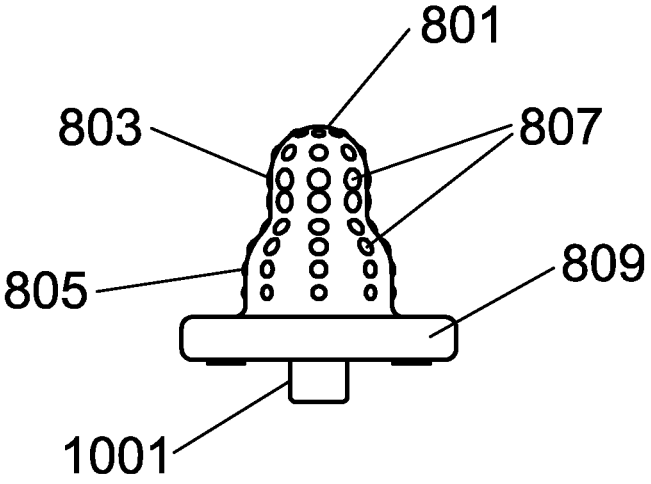
FIG. 13 is a side view rotated ninety degrees with respect to the view of FIG. 12 of the developmental pacifier according to another embodiment of the present invention.

To completely describe and depict the embodiment of the present invention illustrated by way of FIGS. 8-13, FIG. 12 is a side view of the Developmental Pacifier and FIG. 13 is a side view rotated ninety degrees with respect to the view of FIG. 12 of the Developmental Pacifier.

It is, therefore, apparent that there has been provided, in accordance with the various objects of the present invention, a Developmental Pacifier for assisting infants with certain developmental problems, encouraging acceptance of food textures and stimulating oral-motor awareness in children, and reducing or eliminating functional feeding problems in children. While the various objects of this invention have been described in conjunction with preferred embodiments thereof, it is evident that many alternatives, modifications, and variations will be apparent to those skilled in the art. Accordingly, it is intended to embrace all such alternatives, modifications and variations that fall within the spirit and broad scope of the appended claims.

What is claimed is:

1. A developmental pacifier comprising:

a nipple having an upper portion and a lower portion, the length of the upper portion being approximately the length of the lower portion, and the upper portion being 20% to 80% of the diameter of the lower portion;

a plurality of uniformly sized sensory elements directly attached to the surface of both the upper portion and the lower portion of said nipple wherein the sensory elements are configured in rows longitudinal to the length of the nipple and sharing a common origin at the tip of said nipple;

a base attached to the lower portion of said nipple, the base being substantially oval in shape;

a first grip and a second grip attached to the base where each grip consists of a curved rectangular piece protruding orthogonally from the back side of said developmental pacifier base;

each grip having a curve that generally follows the curve of the perimeter of the oval base and being attached symmetrically on each side of said oval base; and two holes wherein each hole perforates said base symmetrically and in proximity to a grip.

2. The developmental pacifier as recited in claim 1, wherein the sensory elements are bumps.

3. The developmental pacifier as recited in claim 1, wherein the nipple is flexible.

4. The developmental pacifier as recited in claim 1, wherein the nipple and the base are one piece.

5. The developmental pacifier as recited in claim 1, further comprising a scent.

6. The developmental pacifier as recited in claim 1, wherein the at least one grip is two curved rectangular pieces each protruding from the back side of said developmental pacifier and placed symmetrically on each side of said oval base.

7. The developmental pacifier as recited in claim 1, further comprising at least one hole that perforates said base.

8. The developmental pacifier as recited in claim 7, wherein the at least one hole is two holes each perforating said base symmetrically and in proximity to said grip.

9. The developmental pacifier as recited in claim 1, further comprising sensory elements attached to said base.

10. A system for treating functional feeding difficulties in children, the system comprising:

a first developmental pacifier comprising a nipple having an upper portion and a lower portion, the length of the upper portion being approximately the length of the lower portion, and the upper portion being 20% to 80% of the diameter of the lower portion, a plurality of uniformly sized minor bumps directly attached to the surface of both the upper portion and the lower portion of said nipple wherein the minor bumps are configured in rows longitudinal to the length of the nipple; a base attached to the lower portion of said nipple, the base being substantially oval in shape; a first grip and a second grip attached to the base where each grip comprises a curved rectangular piece protruding orthogonally from the back side of said developmental pacifier base; each grip having a curve that generally follows the curve of the perimeter of the oval base and being attached symmetrically on each side of said oval base; and two holes wherein each hole perforates said base symmetrically and in proximity to a grip;

a second developmental pacifier comprising a nipple having an upper portion and a lower portion, the length of the upper portion being approximately the length of the lower portion, and the upper portion being 20% to 80% of the diameter of the lower portion, a plurality of uniformly sized bumps attached directly to the surface of both the upper portion and the lower portion of said nipple wherein the bumps are configured in rows longitudinal to the length of the nipple; a base attached to the lower portion of said nipple, the base being substantially oval in shape; a first grip and a second grip attached to the base where each grip comprises a curved rectangular piece protruding orthogonally from the back side of said developmental pacifier base; each grip having a curve that generally follows the curve of the perimeter of the oval base and being attached symmetrically on each side of said oval base; and two holes wherein each hole perforates said base symmetrically and in proximity to a grip; and a third developmental pacifier comprising a nipple having an upper portion and a lower portion, the length of the upper portion being approximately the length of the lower portion, and the upper portion being 20% to 80% of the diameter of the lower portion, a plurality of ridges wherein each ridge extends along the entire circumference of the nipple such that the plurality of ridges form longitudinally spaced rings with bumps on the surface of the ridges, the ridges being attached to the surface of said nipple, a base attached to the lower portion of said nipple, the base being substantially oval in shape, and at least one grip attached to the base.

11. A developmental pacifier comprising:

a nipple having an upper portion and a lower portion, the length of the upper portion being approximately the length of the lower portion, and the upper portion being 20% to 80% of the diameter of the lower portion;

a plurality of uniformly sized bumps directly attached to the surface of both the upper portion and the lower portion of said nipple wherein the bumps are configured in rows longitudinal to the length of the nipple and sharing a common origin at the tip of said nipple;

a base attached to the lower portion of said nipple, the base being substantially oval in shape;

a first grip and a second grip attached to the base where each grip consists of a curved rectangular piece protruding orthogonally from the back side of said developmental pacifier base;

each grip having a curve that generally follows the curve of the perimeter of the oval base and being attached symmetrically on each side of said oval base; and two holes wherein each hole perforates said base symmetrically and in proximity to a grip.

12. The developmental pacifier as recited in claim 11, wherein the nipple is flexible.

13. The developmental pacifier as recited in claim 11, wherein the nipple and the base are one piece.

14. The developmental pacifier as recited in claim 11, further comprising a scent.

15. The developmental pacifier as recited in claim 11, further comprising sensory elements attached to said base.

* * * * *